United States Patent [19]

Gordon et al.

[11] Patent Number: 4,567,831

[45] Date of Patent: Feb. 4, 1986

[54] BULLET TRAP AND BULLET DEFLECTOR IN RIFLE GRENADE

[75] Inventors: Tsvi J. Gordon; David Moseinco, both of Jerusalem, Israel

[73] Assignee: The State of Israel, Ministry of Defence, Military Industries, Israel

[21] Appl. No.: 619,342

[22] Filed: Jun. 11, 1984

[51] Int. Cl.[4] ..... F42B 11/42

[52] U.S. Cl. ..... 102/485

[58] Field of Search ..... 102/485; 42/1 F; 89/143

[56] References Cited

U.S. PATENT DOCUMENTS

| | | | |
|---|---|---|---|
| 1,900,790 | 3/1933 | Brandt | 102/485 |
| 3,620,162 | 11/1971 | King | 102/485 |
| 3,664,263 | 5/1972 | Driscoll | 102/485 |
| 3,726,036 | 4/1973 | Jennings et al. | 102/485 |
| 3,934,513 | 1/1976 | Gabriels | 102/485 |
| 4,052,942 | 10/1977 | Pelausse | 102/485 |

FOREIGN PATENT DOCUMENTS

| | | | |
|---|---|---|---|
| 1578125 | 11/1969 | Fed. Rep. of Germany | 102/485 |
| 2517820 | 6/1983 | France | 102/485 |

*Primary Examiner*—Harold J. Tudor

*Attorney, Agent, or Firm*—Steinberg & Raskin

[57] ABSTRACT

In a rifle grenade assembly a bullet trap and bullet deflector are incorporated to enable the launching of the grenade with ball ammo. The trap is designed to trap the bullet of a fired cartridge and use the forward forces produced by the trapping to advance a fore-located deflector which in turn actuates a fuse. A non-trapped bullet enters a deflecting cavity in the deflector, thus deflecting the bullet away from the fuse and the explosives.

7 Claims, 2 Drawing Figures

BULLET TRAP AND BULLET DEFLECTOR IN RIFLE GRENADE

BACKGROUND OF THE INVENTION

1. Field of the Invention

The present invention is generally directed to improvements in the assembly for launching explosives by means of a rifle and, more particularly, to improvements of the assembly of a rifle grenade in which ball ammunition is to be used.

2. Description of the Prior Art

All known prior art rifle grenade assemblies hereafter simply referred to as the grenade, include a fuse which is intended to be activated by gas pressure from a fired blank cartridge in the rifle. As is known, the gas pressure causes the fuse's aft diaphragm to become deformed in a forward direction toward the explosive matter of the grenade. It in turn pushes fore an arming pin which enables the fuse to be armed and then initiate the explosion of the explosives upon hitting a target. A danger has existed in the prior art in that if instead of loading a blank cartridge into the rifle, ball ammunition or ammo is used. Such ammo has a bullet or core. Thus, upon firing the rifle there is a great danger that the bullet may, and often does, deform the diaphragm thus arming the fuse prematurely very near the soldier, which could lead to an explosion near the soldier and thus endanger him and those around him. It is also possible for the bullet to pass through the entire fuse and penetrate and ignite the explosives, which is clearly most dangerous.

The only solution attempted in the prior art to reduce such dangers, which are created by the unintentional use of ball ammo, is to provide a bullet deflector between the rifle and the fuse. The function of the deflector is to deflect the bullet from continuing its travel along the grenade's direction toward the fuse, by deflecting it to travel at a safe angle away from the axial direction and out of the assembly. It is believed that a rifle grenade which is to be launched with ball ammo rather than with blank cartridges could be made very safe if properly designed. With such a grenade, a soldier would not have to carry special blank cartridges but would be able to use the conventional ball ammo for grenade launching. It is to provide an arrangement in the grenade to provide it with its proper safety that the present invention is directed, as follows:

SUMMARY OF THE INVENTION

In accordance with the present invention there is provided in a rifle grenade assembly of the type including from a fore end to an aft end, explosives in a grenade body, a fuse responsive to pressure forces applied thereto at its aft end for controlling the initiation of the detonation of said explosives, a rifle adapted to be loaded by ball ammunition including a bullet adapted to be propelled fore as a result of the pressure of gases produced in the case of said ammunition upon the triggering of the detonator of said cartridge, the improvement comprising:

bullet travel control means including at least bullet trap means aligned along the longitudinal axis of said assembly between the aft end of said fuse and ahead of said rifle, said bullet trap means including:

matter in the path of said bullet for absorbing at least part of the forward energy of the bullet travelling in the fore direction so as to decelerate said bullet; and a bullet decelerating body in the path of the bullet and defining an axial multi-shaped inwardly directed cavity for decelerating said bullet and align its travel to substantially coincide with the assembly's longitudinal axis as the bullet is being substantially trapped by said bullet decelerating body, substantially along the assembly's longitudinal axis.

In another embodiment of the invention a bullet deflector is associated with the bullet trap. Its function is to deflect any bullet which may not have been trapped by the bullet trap from reaching the fuse or even passing it, and penetrating the explosives. The bullet deflector has a bore extending at an angle to the longitudinal axis of the assembly. The bullet trap includes a body which not only attempts to deform and trap the bullet but is also used to maintain it along the longitudinal axis or axially. Thus, a bullet with excessive acceleration which may not have been trapped by the bullet trap would exit the latter axially and in all probability enter the angular bore of the bullet deflector, to be deflected thereby out of the assembly's housing, without reaching the fuse and/or the explosives. The latter are typically ahead or fore of the fuse. However, the invention is intended to include any arrangement in which the fuse is either aft or fore of the explosives.

The novel features of the invention are set forth with particularity in the appended claims. The invention will best be understood from the following description when read in conjunction with the accompanying drawings.

DETAILED DESCRIPTION OF THE PREFERRED EMBODIMENTS

Figure 1:
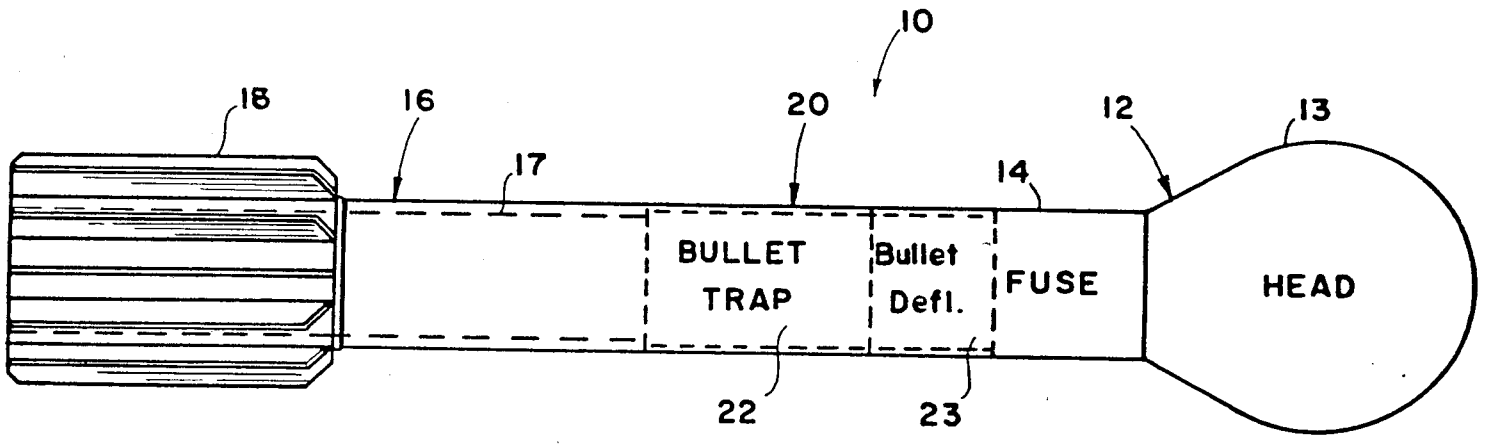
FIG. 1 is a simplified side view of a rifle grenade which includes the invention.

In order to fully appreciate the advantages realized with the present invention, it is believed important to briefly summarize the prior art.

As used in this specification the term "rifle grenade" or simply "grenade" denotes a grenade such as an anti-personnel, a smoke or an anti-tank grenade adapted to be projected by a rifle, carbine or smaller firearm. It comprises a grenade body to which is fitted a tubular, fin stabilized tail. The tail is adapted to be fitted to a rifle muzzle directly or via a suitable adaptor. The grenade body includes explosives and a fuse which is typically aft of the explosives.

Prior art grenades are designed to be propelled to a target by firing a special launching cartridge which, upon detonation, generates propulsion gases. They serve to project the grenade towards its target, with the grenade exploding upon, or immediately prior to, impact as a result of the arming of the fuse.

The rifle or the like which is employed is normally used to fire live bullets. It is only when it is desired to project a grenade that the latter is fitted over the rifle muzzle. A distinct danger therefore arises that, as a result of an oversight, instead of using the required launching cartridge, a live cartridge, i.e. one containing a bullet, will be fired so as to project the grenade. The firing of such a live cartridge with the grenade mounted on the muzzle of the rifle carries with it extreme danger for the firer and for those in his immediate surroundings.

In the prior art, in order to reduce the dangers involved in the accidental firing of a live cartridge rather than the special launching cartridge, it has been proposed to provide such rifle grenades with so-called "bullet deflectors".

These deflectors, located ahead or fore of the muzzle and aft of the grenade body, were designed to deflect any bullet from reaching the grenade body in case a live bullet was used, while enabling the gases, produced by firing the live cartridge, to reach the grenade body, typically the aft end of the fuse to propel the entire grenade to the target while at the same time arming the fuse. It has been found that the need to carry special cartridges for rifle grenade launching by a rifle designed for live cartridges, known as ball ammunition, complicates matters. In the heat of battle the likelihood is high that ball ammo may be used instead of the special cartridges, thus subjecting the soldier and those around him to nearby premature life-endangering explosives.

These and other disadvantages are overcome by the present invention. In accordance thereto the rifle grenade is designed to be fired intentionally by ball ammo, thus eliminating the need for special cartridges. In accordance with the invention bullet trapping means, hereafter also referred to as a bullet trap, is included aft of the fuse. The trap, as will be explained hereafter, is designed to trap the bullet of the ball ammo. Elements of the trap are deformed by the trapped bullet to directly or indirectly initiate the arming of the fuse but without the bullet reaching the former. As to propelling the entire rifle grenade, it is propelled by the energy which is released upon firing the ball ammo in the rifle.

Another aspect of the invention relates to the inclusion of a bullet trap between the bullet deflector and the aft end of the fuse. The function of the deflector is twofold. Under normal conditions the bullet trapped in the trap causes deformation of the parts of the bullet trap which in turn causes advancing of the deflector. Such movement initiates fuse arming. If the bullet manages to exit the trap, the trap and the deflector are designed to maximize the likelihood that an untrapped bullet gets deflected by the deflector thus preventing damage to the fuse and possible explosion in the event the bullet were to penetrate the explosives ahead of the fuse.

In order to put the invention in proper context, attention is directed to FIG. 1, wherein a rifle grenade 10 in accordance with the invention is shown. As in the prior art it includes a forward or fore section 12 with a head 13, containing the explosives, and a fuse 14 aft of it. It also includes a tail section 16 with an.internal bore 17 to enable the rifle grenade to be mounted to a rifle muzzle directly or through an adaptor. At the aft end, stabilizing fins 18 are formed. The rifle grenade of the present invention, unlike the prior art, is designed to be used with live cartridges, known as ball ammunition (ammo). When the rifle is fired with a loaded live cartridge the bullet is propelled fore and the forces of gases propel the entire rifle grenade 10 to the target.

In accordance with the invention the rifle grenade includes a mid-section 20 with a novel bullet trap 22 and preferably a bullet deflector 23. One embodiment of each of the trap 22 and deflector 23 are shown in cross-sectional view in FIG. 2. They are both shown located in a cup shaped housing 25 which fits snugly in the fore end of bore 17. The cup is shown with an outwardly extending flange or rim 25*t* which when pressed between the fore end of bore 17 and the fuse base secures the cup in the bore 17.

The bullet trap 22 is shown including a plurality of energy absorbing elements at the aft end of the trap extending from the bottom of cup 25 forward. They include a rubber disc 31, an aluminium cup 32 with an opening 34, and a steel disc 35. Supported on disc 35 is the main bullet trapping element 40. It is shown with a fore directed cavity 42 which decreases in diameter in the forward direction. It is typically of steel and is symmetrical about the longitudinal axis 45. Preferably a steel ring 46 is included with element 40 resting on both disc 35 and ring 46. As clearly seen from FIG. 2 the outer diameter of element 40 is less than the inner diameter of the cup 25. Thus, free space 47 is provided around the steel element 40.

The bullet trap further includes a plurality of elements fore of the steel element 40. They include a steel disc 51, an aluminium ring 52 and one or more steel discs 53.

Figure 2:
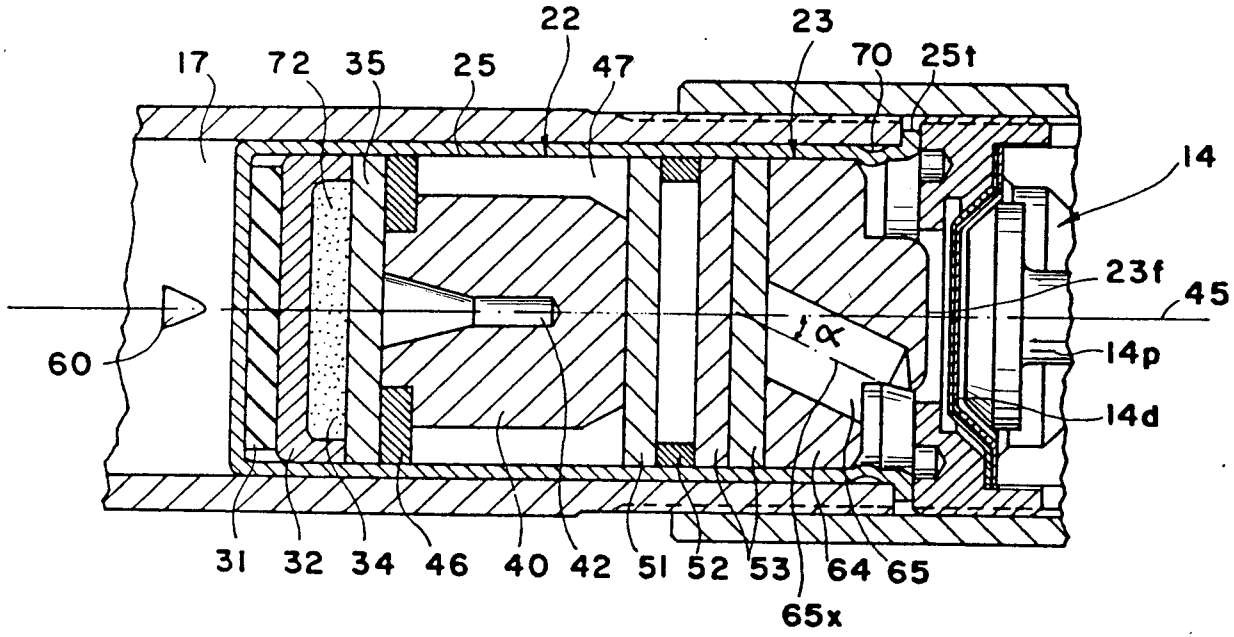
FIG. 2 is a cross-sectional view of a bullet trap and bullet deflector arrangement in accordance with the invention.

In operation, when ball ammo is used in the rifle the slug or bullet, designated in FIG. 2 by 60, is separated from the cartridge casing and is propelled forward by the gases. As it travels forward, the bullet first encounters the cup bottom which it pierces. It successively pierces and passes through elements 31 and 32 and 35, before reaching the steel element 40. These elements absorb part of the bullet's forward thrust, thus slowing it down, before the bullet reaches the steel element 40. The steel ring 46 helps in aligning the bullet to enter element 40 via cavity 42.

The steel element 40 serves two functions. One is to trap the bullet 60 and prevent it from advancing into the fuse 14. The other function may be explained as follows. As a result of bullet trapping the volume of element 40 increases and thus deforms the elements ahead of it, thereby providing a forward force. In an arrangement wherein a bullet deflector is included fore of the trap, this forward force serves to deform elements of the deflector which in turn press against the fuse diaphragm 14*d*. It in turn pushes forward a fuse arming piston 14*p* to start the fuse arming process.

In the present invention, the steel element 40 upon trapping a bullet expands into the free space 47 around it. As to the cavity 42 it is symmetrical about axis 45 and thus helps retain the bullet along axis 45. Cavity 42 is preferably cone shaped followed by a cylindrical section. In the cone shaped section slug energy is gradually dissipated and finally the slug is trapped in the cylindrical part of the cavity, while the volume of element 40 increases into space 47. Elements 51–53 are added to provide an added margin of protection to trap the bullet in the event one had enough energy to pass through the entire element 40 and exits through its fore face.

To provide further protection the bullet deflector 23 is preferably added. It includes an aluminum element 64 with a mesa shaped fore face 23*f*. The mesa is juxtaposed to fuse diaphragm 14*d*. It also includes an inclined bore or hole 65 whose longitudinal axis 65*x* forms an acute angle $\alpha$ with axis 45.

In normal operation the trap 22 is designed to trap the types of bullets capable of being fired by the rifle in the steel element 40. Fuse actuation is achieved as a result of forward deformation of the face element of the trap and block 64 of the deflector 23 if the latter is employed. However, if the forward energy of the bullet is so high that it pierces and passes through the trap it is deflected into hole 24 and out of the rifle grenade. Also, no fuse actuation takes place. By forming element 40 with axially symmetrical cavity 42 as well as by adding ring shaped elements 46 and 52 the path of travel of any bullet is maintained to be along axis 45. Thus, if a bullet were to pass through the entire trap the likelihood that it will be deflected into hole 64 is maximized, since the latter extends from the axis 45 outwardly at the angle $\alpha$.

After all the elements are placed in cup-shaped housing 25 an indentation 70 is formed at its upper end to secure all the parts in it.

Although particular embodiments of the invention have been described and illustrated herein, it is recognized that modifications and variations may readily occur to those skilled in the art.

For example, it is within the contemplation of the present invention to include black powder 72 in opening 34 of cup 32. Such powder ignites by the penetrating bullet 60 to provide added speed, on the order of 20 percent or more, without endangering the soldier. Consequently, it is intended that the claims be interpreted to cover such modifications and equivalents.

We claim:

1. In a rifle grenade of the type having a fore section including a fuse and a head section with triggerable explosives, the grenade being launchable by the pressure of gases from a live round of ammunition with bullet fired by the rifle used to launch the grenade, comprising in combination:

bullet trap means positioned in said rifle grenade aft of said fore section and symmetrically aligned with respect to the longitudinal axis of said rifle grenade for trapping the bullet of said live round of ammunition exiting the rifle bore to prevent it from penetrating the rifle grenade's head section, said bullet trap means including a main bullet trapping element with a multi-shaped axial cavity inwardly directed from an aft end, to substantially trap the bullet by gradually absorbing the energy thereof, while said element expands in volume; and bullet deflector means aft of said fore section and fore of said bullet trap means for deflecting away from said head section a bullet not trapped by the bullet trap means.

2. A rifle grenade according to claim 1 wherein said bullet deflector means comprise a block of matter with a bore adapted to capture a bullet arriving from said bullet trap means and extending at an acute angle with respect to the longitudinal axis of the grenade whereby a captured bullet is deflected away from said longitudinal axis.

3. A rifle grenade according to claim 1 wherein said bullet trapping means include powder ignitable by a passing bullet for increasing the speed thereof.

4. A rifle grenade according to claim 1 wherein said fuse comprises an aft element which when subjected to fore forces initiates the arming of the fuse, said aft element comprising control means associated with said main trapping element and including elements deformable as a result of the trapping of a bullet by said bullet trap means whereby a forward force is applied to the aft element of the fuse to initiate fuse arming.

5. A rifle grenade according to claim 2 wherein said bore has an open aft end situated substantially centrally at an aft surface of said block and substantially symmetrical with respect to the longitudinal axis of the grenade.

6. A rifle grenade according to claim 1 further including at least one solid member situated between said bullet trap means and said bullet deflector means.

7. A rifle grenade according to claim 2 further including at least one solid member situated between said bullet trap means and said bullet deflector means, said solid member overlying an aft end of said bore of said deflector means.

* * * * *